United States Patent [19]

Lang

[11] Patent Number: 5,024,899

[45] Date of Patent: Jun. 18, 1991

[54] RESILIENT METALLIC FRICTION FACING MATERIAL

[76] Inventor: Richard D. Lang, 412 Wallace Ave., Crawfordsville, Ind. 47933

[21] Appl. No.: 601,289

[22] Filed: Oct. 22, 1990

[51] Int. Cl.[5] ..... B22F 3/10

[52] U.S. Cl. ..... 428/550; 428/552; 428/553; 419/2; 419/27; 420/590

[58] Field of Search ..... 428/550, 552, 553; 419/420, 2, 27; 420/590

[56] References Cited

U.S. PATENT DOCUMENTS

| | | | |
|---|---|---|---|
| 4,327,156 | 4/1982 | Dillon et al. | 428/545 |
| 4,554,218 | 11/1985 | Gardner et al. | 419/27 |
| 4,710,223 | 12/1987 | Matejczyk | 419/27 |

*Primary Examiner*—Stephen J. Lechert, Jr.

*Attorney, Agent, or Firm*—Juettner Pyle & Lloyd

[57] ABSTRACT

The improved friction facing has a porous, resilient fused metallic matrix with a second metal having a lower boiling point being infused into and alloyed with the matrix.

6 Claims, No Drawings

RESILIENT METALLIC FRICTION FACING MATERIAL

BACKGROUND OF THE INVENTION

This invention generally relates to friction materials which are used in torque transmitting apparatus having a friction facing material operatively engageble with an opposing surface in the presence of a transmission fluid or oil. More particularly, the invention relates to a friction facing material comprising metallic particles in the form of a porous body having excellent friction properties and durability, and to the method for making such materials.

The torque transmitting apparatus referred to above may comprise, for example, clutch and brake assemblies having a friction disc and an opposed plate. The friction facing material, in the form of a grooved or ungrooved disc, or disc segments, is secured to a metallic core to provide a friction or torque transmitting surface thereon. The opposing plate provides a cooperating surface which operatively engages the friction surface for torque transmission. A plurality of discs having friction facing material on opposed surfaces are normally interleaved with a plurality of opposing plates to provide a multiple disc clutch. Torque transmission is regulated by closing means which control the axial proximity of the adjacent discs and plates.

The disc and opposing plate may extend to a reservoir of transmission fluid, or the fluid may be delivered to the disc under pressure from such reservoir or from a remote reservoir. The fluid serves to cool the apparatus by dissipating the heat energy resulting from torque transmission, which is referred to as wet operation of the unit. The fluid may also serve to transmit torque by the shearing of films of fluid between adjacent discs and plates, as well as to dissipate heat, which is referred to as hydroviscous operation of the apparatus.

The heavier duty torque-transmitting apparatus and applications of concern herein are of the type encountered in large road vehicles, such as buses and trucks as well as off-the-highway and construction vehicles. In order to meet the torque loading requirements of such applications, friction facing materials composed of graphite in a powdered metal matrix pressed using high pressures to form a green compact and then sintered at high temperatures and pressures have been developed.

Another type of friction material involves the use of relatively high proportions of abrasive or ceramic materials with minimal proportions of graphite in a powdered metal matrix. These loose mixtures are sprinkled onto a metallic core and then sintered in place to form a facing and to bond the facing to the metallic core. While these types of friction facing materials exhibit a relatively high dynamic coefficient of friction they are limited to less severe applications due to their limitations in energy absorption rates.

The torque transmission characteristics are determined by a number of factors, including the particular transmission fluid and the friction facing material as well as the nature of the cooperating opposing plate surface. The resiliency of the friction facing is a major contributing factor to the torque transmission characteristics in that more resilient friction facings conform better to the opposing plate surface thereby providing more uniform energy absorption over the area of the friction facing. More resilient friction facing generally can tolerate higher energy absorption rates due to the more uniform absorption of energy over the area of the facing. Less resilient friction facings are limited in their rate of energy absorption by this same factor. Heretofore, metallic based friction facings have exhibited low levels of resiliency and as a result have been limited in their rate of energy absorption. Metallic based friction facings manufactured utilizing high pressures to form a green compact are limited in resiliency due to the dense structure of the friction facing obtained with this method. Metallic based friction facings manufactured using the sprinkling process are limited in resiliency due to the coarse rigid metallic matrix inherent with these type of friction facings.

SUMMARY OF THE INVENTION

In view of the foregoing, an object of this invention is to provide a wet friction material which is durable and which also exhibits a high level of dynamic friction while having excellent energy absorption characteristics.

Another object of this invention is to provide a friction facing of the type described which is easy to manufacture and has a resilient metallic structure.

The above objectives are generally accomplished by first providing a porous intermediate structure, in which the structural elements are metallic. This may be accomplished by the formation of green compact of metallic fiber and powder using a temporary organic binder and conventional additives such as carbon and friction particles. The compact is formed at relatively low pressures and is then heated to remove the binder and to partially sinter the metallic components together, leaving a porous and relatively weak structure.

The porous intermediate structure is then heated and exposed to an infusion of the vapor of a metal having a melting point lower than the intermediate, with the metal vapor being capable of wetting or alloying with the metals in the intermediate. Upon cooling, the allow serves to substantially increase the strength and integrity of the structure, and yet the final structure is porous, resilient, and heat conducting.

The friction material of the present invention is more resilient than prior art materials, which are sintered in a one step operation under high temperatures and pressures to provide a dense and compact structure. The resiliency of the present material allows it to better conform to the surface of a mating plate. In addition, the resiliency, porosity and heat conductivity of the material all contribute to an improved energy absorption capacity without interfering with a high level of dynamic friction.

DESCRIPTION OF PREFERRED EMBODIMENTS

The present invention contemplates the formation of a porous intermediate metallic structure, followed by infusion with a metal vapor as hereinafter described.

In order to prepare the intermediate product, a green compact is first prepared. The green compact is made up from a uniform mixture of metallic powder and fiber, carbon, optional friction particles, and sufficient temporary binder to hold the mixture together upon application of pressures of less than five tons per square inch.

Excluding the weight of the green binder, which is later removed, the dry mixture will comprise from about thirty to about 80 percent metal powder, metal fiber and mixtures thereof, from about five to about forty percent carbon, and from zero to about thirty percent friction modifying particles. The preferred metals are copper and bronze, although others, such as aluminum, nickel, chromium, and ferrous-based materials such as stainless steel, carbon steel, and the like, may be employed. Preferably, the metallic powders and fibers employed are relatively fine, which allows a uniform mixture to be prepared, better filling into a cavity, and better point bonding. The metallic materials as employed provide the structure for the porous intermediate product and also provide the basis for the structure of the final product. Metal fibers and powders shall be referred to herein as "metal particles".

The carbon employed may be of various types and may be provided in crystalline forms, such as graphite, and in its amorphous forms, such as carbon black, petroleum coke, lamp black, charcoal and the like. The purpose of the inclusion of carbon or its equivalent is as a lubricant to prevent the friction material from seizing up against the friction plate during extreme conditions, i.e., at high temperatures and pressures.

Friction modifying particles, especially abrasives, may be optionally included in the mixture at levels up to about 30 percent by weight. The abrasives include silica, alumina, pumice and others well known in the art of friction materials. These materials may be added to alter the final friction characteristics of the friction material, and in many applications, an amount of less than ten percent will be sufficient.

The green binder employed is in the form of a dry powder, preferably an organic material, which may be later removed from the structure by heating or oxidation. Suitable materials include cellulose-based materials such as microcellulose, starch and the like. Typically, an amount of binder, in the order of about ten to about twenty-five percent, based on the combined total weight of the other dry materials, will be sufficient to temporarily hold the mixture together.

The dry mixture is placed in a mold cavity and is cold pressed at relatively low pressures, on the order from about two to about five tons per inch, in comparison with 15–20 tons normally used in powder metallurgy. The resulting green compacts have sufficient strength to allow them to be handled and further processed.

The green compacts are then heated in an oxidizing environment in order to burn out or otherwise remove the green binder while leaving the other components intact in the structure. The atmosphere in the furnace is then changed to a reducing atmosphere, and the heating is continued for a period of time sufficient to reduce substantially all metallic oxides which may have formed during burn-out. For example, the heating stage may be carried out at ambient atmospheric pressure at temperatures in the order of from about !500° to about 1700° F. for copper-based materials.

The intermediate product obtained from the above procedure will comprise a highly porous matrix of substantially oxide free metals which are partially fused by heating in the furnace, and this matrix continues to stably support the carbon and any other additives in the stable manner.

The porous intermediate is then infiltrated with a metal which has a boiling point less than the melting point of the matrix, with said metal being alloyable with metals of the matrix. In connection with the metals employed in the intermediate as described above, zinc and cadmium are uniquely suitable for this purpose, with zinc being preferred due to processing requirements.

The infiltration is carried out in a furnace at approximately one atmosphere wherein the atmosphere contains, or is saturated with, the vapor of the metal. This may be accomplished by placing the metal, in powder or sheet form, into the furnace, or on top of the compacts, and heating the furnace to a temperature sufficient to melt and at least partially volatilize the metal. For example, in the case of zinc, which has a melting point of approximately 788° F. and a boiling point of about 1605° F., a furnace temperature in the order of from about 1450° F. to about 1650° F. may be employed.

Under the conditions described above, the infusing metal wets and alloys with at least some of the matrix metal, and serves to increase or reinforce the structural bond between the various points of contact between the metallic fibers and powders in the compact. While the intermediate undergoes a substantial weight increase during this procedure, usually in excess of 50%, the final product is still porous and resilient.

In contrast with prior art sintered friction materials, the heating operations are carried out at atmospheric pressure, and no additional pressure is required. In prior art processes, the materials were heated under pressure in order to obtain acceptable density, hardness and wear properties. The process of the present invention is advantageous since a single conventional furnace may be employed.

While the friction material of the present invention may be prepared in any desired shape or form, the usual form is in the form of a thin member or disc. The disc may be secured to a supporting member or core which is used in a wet clutch or brake assembly. For example, the friction disc can be secured to a steel core using conventional soldering paste under heat and pressure.

The metallic friction material resulting from the above process is porous, and unlike conventional sintered materials, is resilient. The degree of resilience may be reduced if desired by subjecting the mounted wafer to pressure sufficient to reduce the thickness and resilience thereof.

In further illustration of the invention, the following example is given.

EXAMPLE I

The materials indicated in the following table were dry blended in a cone blender to provide an intimate mixture. A quantity of the blended mixture was deposited in a mold cavity and cold pressed at room temperature and at a pressure of about 3.3 tons/in$^2$ to provide green compacts.

| | |
|---|---|
| Avicel[1] | 15% |
| Bronze Fiber, chopped[2] | 20% |
| Copper Powder[3] | 41% |
| Graphite[4] | 20% |
| Silica[5] | 4% |

[1]Microcrystalline cellulose by FMC Corporation.
[2]Type CDA 649 bronze. Grade #0, by International Steel Wool Corporation, chopped to yield an apparent density of approximately 1.15 g/cc.
[3]D-101 copper powder from U.S. Bronze Corporation
[4]Powdered artificial graphite #1156 by Asbury Graphite Mills, Incorporated
[5]AGS-325 mesh 102 silica by Agsco Corporation Most of the Avicel in the green friction facing compacts was removed from the compacts by processing the compacts in a furnace for two hours at 1600° F.

under an atmosphere composed of approximately 93% water vapor −7% nitrogen. After the initial two hours the atmosphere in the furnace was changed to 100% hydrogen and the furnace processing continued for an additional one hour at 1600° F. to reduce any metallic oxides in the metal matrix of the friction facing back to their base metal state. During this operation no external pressure was imposed on the compacts.

Powdered zinc was then sprinkled on the burnt-out compacts and the compacts underwent a second furnace operation to melt the powdered zinc and infiltrate the compact below. The second furnace operation was carried out at 1560° F. for one hour under an atmosphere composed of hydrogen saturated with metallic zinc vapor. After the infiltrating process the compacts experienced a weight increase on average of 61% as compared to the weight of the compacts before the infiltrating process. Once again, during this operation no external pressure was imposed on the compacts.

Once infiltrated the compacts were cooled and bonded to a metallic core coated with a commercial soldering paste. The bonding operation utilized 600° F. and a pressure of 300 PSI for approximately five minutes.

The friction facing material as described above was tested in comparison with a standard sintered friction material. The test involved identical conditions in the same type of transmission fluid and in the same test apparatus in which the material is brought into engagement with a plate. The materials were tested for 2,000 engagements at three successively higher energy levels. The first level simulates loadings in highway passenger bus and tractor trailer applications and corresponds with a unit kinetic energy value of 390 ft-lbs/in$^2$. The second energy level simulates the loads encountered in off-highway equipment, such as construction vehicles, and such loads correspond with a unit kinetic energy value of 530 ft-lbs/in$^2$. The third energy level corresponds with overload conditions not expected to be of regular frequency or long duration in actual application and has a unit value of 820 ft-lbs/in$^2$.

TABLE I

| | CONVENTIONAL WAFER | PRESENT INVENTION |
|---|---|---|
| Dynamic Coefficient of Friction (Average) | | |
| 1st Energy Level | .055 | .103 |
| 2nd Energy Level | .049 | .102 |
| 3rd Energy Level | .039 | .089 |
| Wear (mils) | | |
| 1st Energy Level | 1.1 | 2.1 |
| 2nd Energy Level | .3 | .3 |
| 3rd Energy Level | .4 | 1.6 |
| Total Wear | 1.8 | 4.0 |

1st Energy Level, 14,270 ft-lbs, 2000 engagements
2nd Energy Level, 19,490 ft-lbs, 2000 engagements
3rd Energy Level, 29,940 ft-lbs, 2000 engagements
DA Torque Fluid used in all levels

I claim:

1. An improved metallic friction facing material comprising a porous, resilient fused metallic matrix, said matrix comprising partially fused first metal particles and a second metal having a lower boiling point than the first metal, said second metal being infused into and alloyed with said metal particles.

2. The improved metallic friction facing material of claim 1 additionally comprising carbon.

3. The improved metallic friction facing material of claim 2 additionally comprising abrasive particles.

4. An improved metallic friction facing material comprising a porous, resilient and partially fused metallic substrate, and metal of lower melting point infused and alloyed with said substrate, said substrate comprising, by weight of the substrate, from about 30 to about 80 percent metal particles, from about 5 to about 40 percent carbon, and from zero to about thirty percent friction modifying particles.

5. The improved metallic friction facing material of claim 4 wherein said metal particles are selected from the group consisting of copper, aluminum, nickel, chromium and ferrous metals, alloys and mixtures thereof, and said metal of lower melting point is selected from the group consisting of zinc and cadmium.

6. The improved metallic friction facing material of claim 4 wherein said metal of lower melting point constitutes more than 50 percent of the weight of the final product.

* * * * *